US006092313A

United States Patent [19]

Dunlap et al.

[11] Patent Number: 6,092,313

[45] Date of Patent: Jul. 25, 2000

[54] APPARATUS FOR INTERCHANGEABLY AFFIXING A TOOL TO FOOTWEAR

[76] Inventors: Gary Earnest Dunlap, 1863 Coffman Springs Rd.; Douglas Franklin Ingram, P.O. Box 705, both of Lafayette, Ga. 30728

[21] Appl. No.: 09/118,662

[22] Filed: Jul. 17, 1998

[51] Int. Cl.[7] ..... A43C 17/02

[52] U.S. Cl. ..... 36/132; 36/136

[58] Field of Search ..... 36/1, 132, 136, 36/113; 15/227

[56] References Cited

U.S. PATENT DOCUMENTS

| | | | |
|---|---|---|---|
| 391,738 | 10/1888 | Cross | 36/1 X |
| 599,495 | 2/1898 | Durel et al. | 15/227 X |
| 1,582,232 | 4/1926 | Vinzant | 36/72 R |
| 2,114,790 | 4/1938 | Venables | 36/132 X |
| 3,680,170 | 8/1972 | Sims | 15/227 X |
| 3,906,646 | 9/1975 | Milotic | 36/100 |
| 4,693,022 | 9/1987 | Terhune | 36/132 |
| 4,821,434 | 4/1989 | Chein | 36/134 |
| 4,945,659 | 8/1990 | De Marchi et al. | 36/132 X |

*Primary Examiner*—M. D. Patterson
*Attorney, Agent, or Firm*—Donald R. Andersen

[57] ABSTRACT

An apparatus is provided which includes a platform to be strapped to the sole of footwear and an attachment carrying a tool which slidingly engages said platform, for providing an apparatus for interchangeably affixing a tool to footwear for work on floor and base board surfaces.

8 Claims, 2 Drawing Sheets

APPARATUS FOR INTERCHANGEABLY AFFIXING A TOOL TO FOOTWEAR

BACKGROUND OF THE INVENTION

The present invention relates to the art of interchangeably affixing a tool to a shoe or other footwear.

Prior to the present invention the use of a tool to perform tasks on a floor surface or base board either required the use of hands to hold a long handle to which the tool is attached or required the person using the tool to kneel or sit on the floor to use the tool. Many tools require repetitive and forceful application of the tool to the floor. The use of the leg and foot to manipulate the tool would be far better suited to effective use of the tool than the use of the hands or even the arms when kneeling or sitting on the floor, or pushing a long handled device.

SUMMARY OF THE INVENTION

The present invention enables a tool to be affixed to the shoe or other footwear of the worker in such a manner that the full weight and force of the leg can be applied in a repetitive manner to use the tool on the floor or base board. The tool affixed to the shoe or other footwear may be a brush, a scraper, a sander, a sponge or other tool commonly used on a floor or base board. The tool is affixed to the shoe or other footwear by means of a platform to which the tool is permanently affixed.

It is a further benefit of the present invention that the tool may be interchangeably affixed to the shoe or other footwear.

It is another benefit of the present invention to allow a tool to be affixed to a shoe or other footwear in such a manner that the full weight and force of the body and leg can be applied to the tool.

These and other benefits of the present invention will be apparent from a review of the following specification and drawings in which like numbered parts are described in the specification and shown in the drawings.

SPECIFICATION AND DESCRIPTION OF A PREFERRED EMBODIMENT

Figure 1:
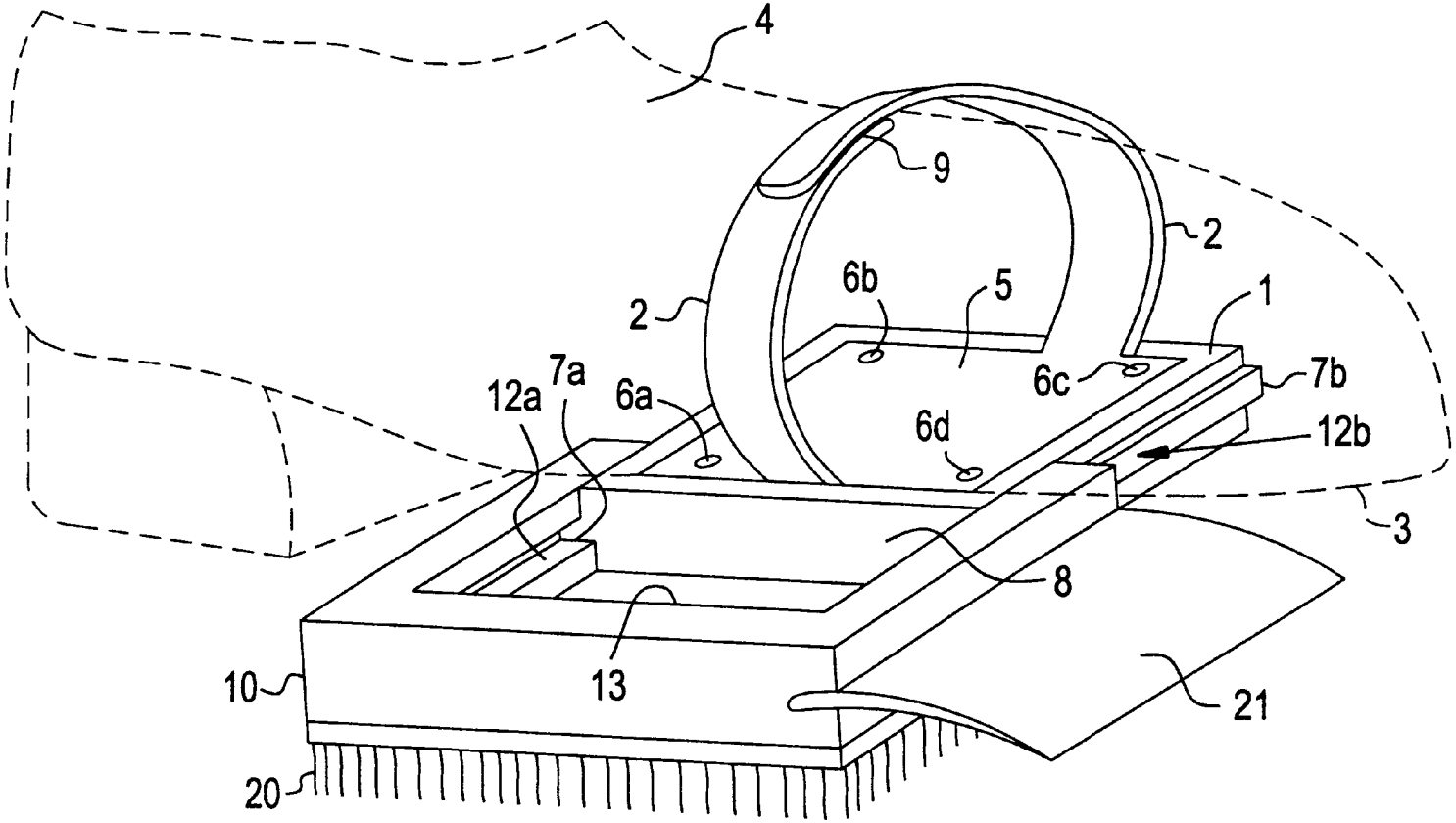
FIG. 1 is a perspective drawing of a preferred embodiment of the present invention.

The preferred embodiment shown in FIG. 1 includes a platform 1 having straps 2 used to fasten the platform 1 to the sole 3 of the shoe or other footwear 4. In the preferred embodiment the platform 1 is substantially flat having plate 5 to which the straps 2 are attached. The straps include a fastener 9, such as a hook and loop fastening means, such as VELCRO but could use any conventional fastening device, such as a buckle. The plate 5 is bolted to the platform 1 with fasteners 6*a*, 6*b*, 6*c* and 6*d*. The platform 1 has beveled edges 7*a* and 7*b* at the front and rear edges, respectively, of the platform 1. The platform 1 has a substantially flat top surface which conforms to the sole of the shoe or other footwear.

The platform 1 slidingly fits into an attachment 10 to which the tool 11 is permanently affixed. The attachment 10 shown in the preferred embodiment is substantially flat on the bottom and is recessed on the upper surface to accept the platform 1. The interior edges of the top of the attachment 10 include channels 12*a* and 12*b* which accept the beveled edges 7*a* and 7*b* of the platform 1 when the attachment 10 is slidingly engaged into the platform 1. The attachment 10 includes an abutment 13 at one of the sides of the attachment 10 which abuts the edge 8 of the platform 1 so as to prevent the attachment from sliding further on the attachment 10 when the tool is in use.

Figure 2:
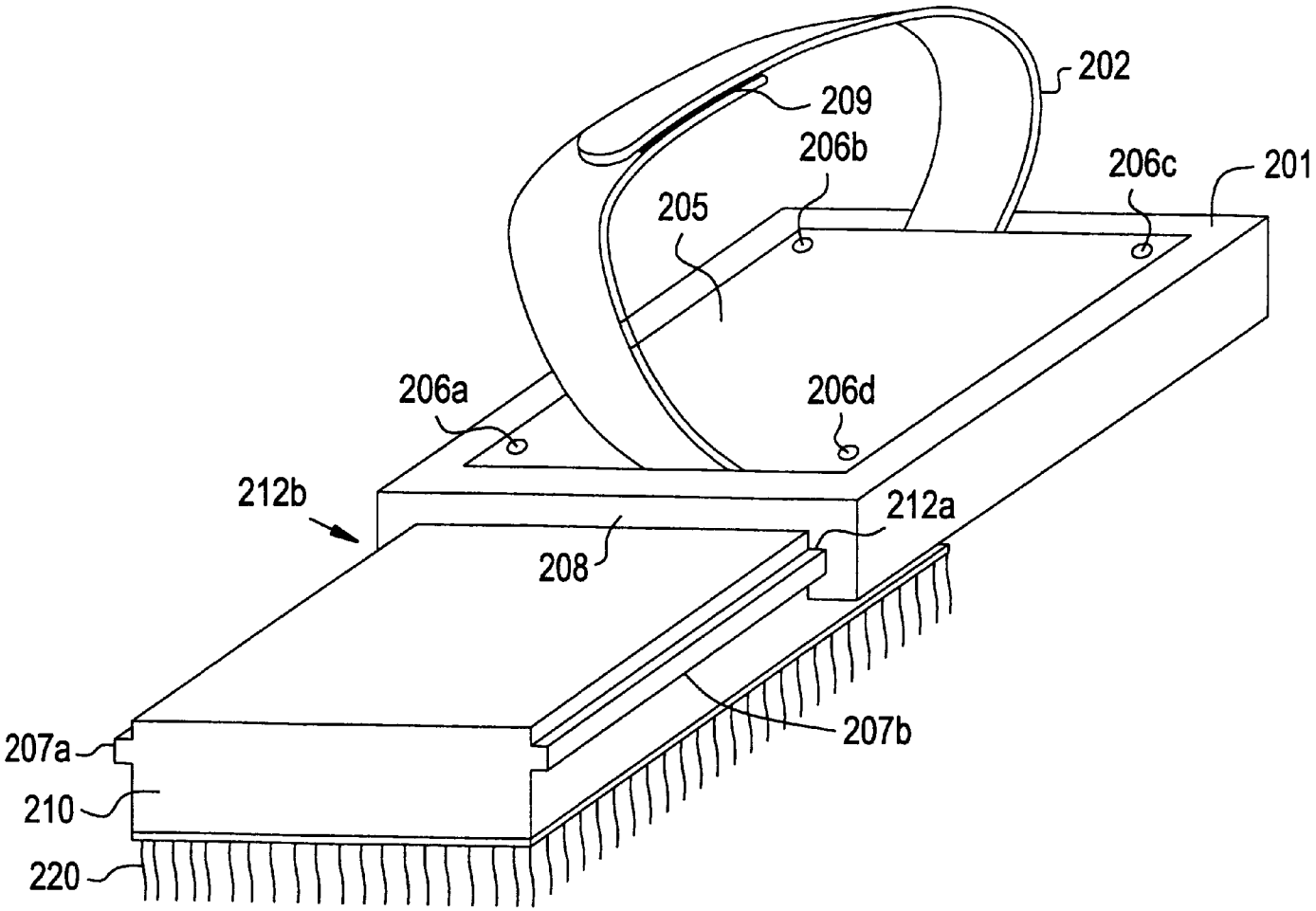
FIG. 2 is a perspective drawing of an alternative embodiment of the present invention.

It will be understood by those skilled in the art that the manner and shape of affixing the attachment to the platform may vary in order to perform substantially the same function in a substantially similar manner. For example, as shown in FIG. 2, the laterally displaced channels 212*a* and 212*b* could be provided as a part of the platform 210 for engaging the edges 207*a* and 207*b* of the tool, within the platform 208, thus reversing the method of engagement shown in the preferred embodiment of FIG. 1. Additionally, the platform and the tools could be affixed by a threaded, bayonet or twist lock fastening method, or even by easily removable bolts and snaps.

Referring again to FIG. 1, the tool shown in the preferred embodiment is a brush 20. It will be understood by those skilled in the art that the tool may be a brush 20, scraper 21, or another tool such as a sander or polisher, adapted to be used on a flat floor surface or a base board, either alone or mounted in combination with another tool as shown on the attachment 10. The individual working surfaces also may be replaced or interchangeable on the tool. For example, sandpaper may be attached to the bottom of the tool by adhesive, or the brush may be interchangeable with a polisher or a sponge surface.

The preferred embodiment is used by attaching the platform 1 to the user's shoe or other footwear by the straps shown in FIG. 1. The attachment 10 is then slidingly engaged with the platform 1 until the abutment 13 engages the lateral edge of the platform 1. The user then applies the tool to the floor surface using the leg and foot to provide the necessary force to the floor surface. The user also applies the tool to the floor surface in a repetitive or other manner so as to achieve the desired results on the surface of the floor.

From the foregoing description of a preferred embodiment, those skilled in the art will appreciate that the present invention includes other embodiments and is limited solely by reference to the following claims.

We claim the following:

1. An apparatus for affixing a tool to footwear comprising:

(a) a platform wherein said platform includes opposing beveled edges;

(b) a means for securing said platform to said footwear;

(c) a tool; and (d) a means for interchangeably attaching said tool to said platform, including laterally displaced channels on the tool for receiving said opposing beveled edges of the platform.

2. An apparatus as claimed in claim 1, wherein said laterally displaced channels on the tool are substantially horizontal.

3. An apparatus as claimed in claim 1 wherein said means for attaching said tool to said platform includes a means for affixing the position of the tool relative to the platform.

4. An apparatus as claimed in claim 3 wherein said tool includes a stop and said means for affixing the position of tool relative to the platform includes a surface on the platform for receiving said stop.

5. An apparatus as claimed in claim 4 wherein said tool includes a raised section perpendicular to said laterally displaced channels and wherein said raised section provides a stop for affixing the relative position of said tool relative to the platform.

6. An apparatus for affixing a tool to footwear, comprising:

(a) a platform wherein said platform includes laterally displaced channels;

(b) a means for securing said platform to said footwear;

(c) a tool; and (d) a means for interchangeably attaching said tool to said platform which includes tracks on laterally displaced opposing edges of the tool and wherein said laterally displaced channels on said platform receive said tracks.

7. An apparatus as claimed in claim 6, (a) a substantially flat rectangular platform to conform to the bottom of footwear wherein said platform includes opposing edges;

(b) a means for securing said platform to said footware including a means for interchangeably removing such tool from said platform having laterally displaced channels on the tool for receiving opposing edges of said platform;

(c) wherein said tool includes a stop, and wherein said platform includes a means for affixing the position of the tool relative to the platform having a surface for receiving said stop.

8. An apparatus as claimed in claim 7 wherein said tool includes a raised section perpendicular to said laterally displaced channels and wherein said raised section provides a stop for affixing the relative position of said tool relative to the platform.

* * * * *